United States Patent [19]

Messineo

[11] Patent Number: 4,572,502

[45] Date of Patent: Feb. 25, 1986

[54] STAND FOR STATIONARY BICYCLING

[75] Inventor: Leonard E. Messineo, Glenview, Ill.

[73] Assignee: All American Products, Inc., Gurnee, Ill.

[21] Appl. No.: 491,892

[22] Filed: May 5, 1983

[51] Int. Cl.[4] ..... A63B 21/00

[52] U.S. Cl. ..... 272/73

[58] Field of Search ..... 272/73; 280/293, 295, 280/296, 299, 302; 211/17, 22

[56] References Cited

U.S. PATENT DOCUMENTS

| | | | |
|---|---|---|---|
| 987,753 | 3/1911 | Silsby | 280/299 |
| 2,680,021 | 7/1952 | Sbarra | 272/73 |
| 3,931,991 | 1/1976 | Marchello | 211/22 |
| 4,021,034 | 5/1977 | Olesen | 272/73 |

FOREIGN PATENT DOCUMENTS

| | | | |
|---|---|---|---|
| 2153983 | 5/1973 | Fed. Rep. of Germany | 272/73 |

*Primary Examiner*—Richard J. Apley
*Assistant Examiner*—S. R. Crow
*Attorney, Agent, or Firm*—Neuman, Williams, Anderson & Olson

[57] ABSTRACT

The disclosure describes a stationary bicycling stand which supports the rear wheel of a bicycle above a supporting surface and stabilizes the bicycle during stationary operation. The stand comprises a base which contacts the supporting surface on both sides of the rear wheel and at least two rigid support members having a lower portion attached to the base and an upper portion attached to the bicycle frame at two generally vertically spaced positions. The stand may additionally comprise a third rigid brace having a first and second portion. The first portion is attached to and extends beneath and generally parallel to a central section of the bicycle frame and the second portion attaches to the base.

4 Claims, 4 Drawing Figures

STAND FOR STATIONARY BICYCLING

BACKGROUND OF THE INVENTION

1. Field of the Invention

This invention relates to a stand for securely supporting, laterally, longitudinally and vertically, the rear wheel assembly of a bicycle above a supporting surface allowing the bicycle to be safely and comfortably ridden indoors in a stationary position.

2. Description of the Prior Art

Bicycling is an increasingly popular means for enjoying the outdoors and obtaining the aerobic exercise necessary for people with sedentary lifestyles. Unfortunately, the weather is not always favorable, and bicycling becomes not only uncomfortable, but dangerous during rain or snow or extremes of temperature, which is encountered a large part of the time in much of the country. Since continuity is the key to an effective exercise program, the person who desires to exercise through the use of a bicycle must eliminate this dependence on favorable weather.

Several options are available. The cyclist could choose to cycle only indoors on a stationary cycle. This deprives him, however, of one of the principal advantages of bicycling—enjoying the outdoors. He could purchase a stationary cycle in addition to a bicycle, but this is an expensive alternative. Stationary cycles cost as much as ten-speed bicycles, and sometimes even more.

A far less expensive alternative is the use of a stand which supports the rear wheel of the bicycle above a floor to allow stationary bicycling indoors. Such a stand is considerably less expensive than a stationary cycle, yet it allows the cyclist the flexibility to bicycle both indoors and outdoors. Consequently, the cyclist maintains a regular pattern of exercise.

The use of stands for holding the rear wheel of the bicycle above the floor has been suggested in the art previously. See, for example, Jordaan U.S. Pat. No. 4,322,070; Alvarez U.S. Pat. No. 4,262,899; Olesen U.S. Pat. No. 4,021,034; and Uhl et al. U.S. Pat. No. 3,979,113. Although the prior art stands managed to hold the rear wheel of the bicycle above the floor, they failed to adequately resolve many other problems associated with stationary bicycling. For example, they failed to adequately support against the wobbling and vibrations generated when the cyclist was pedaling; they failed to satisfactorily prevent the stand from "walking" along the floor; they frequently entailed a bulky construction which interfered with the movement of the cyclist or the moving parts of the bicycle; and they failed to provide a means for readily attaching and detaching the bicycle from the stand.

SUMMARY OF THE INVENTION

The general object of the invention is to provide an improved stationary bicycling stand. Further objects include providing a stationary bicycling stand that not only holds the rear wheel above the floor, but also holds the bicycle steady while it was being operated in a stationary position; providing a stationary bicycling stand that stabilizes the bicycle without interfering with the pedaling cyclist or the moving parts of the bicycle; providing a stationary bicycling stand that readily attaches to and detaches from the bicycle without marring the frame; and providing a stationary bicycling stand that accommodates several styles and sizes of bicycles.

Accordingly, the present invention encompasses a stationary bicycling stand for supporting the rear wheel of a bicycle above a floor or other supporting surface. The stand comprises a base which rests on the floor on each side of the rear wheel and at least two rigid braces which have an upper portion and a lower portion. The lower portion is attached to the base, and the upper portion is generally parallel to the plane of rotation of the rear wheel and is attached to the bicycle frame at at least two generally vertically spaced positions.

The present invention also encompasses the stationary bicycling stand of the previous paragraph further comprising a third rigid brace having a forward and rearward portion. The rearward portion is attached to the base, and the forward portion is attached to and extends beneath and generally parallel to a portion of the bicycle frame between the front and rear wheels.

Further objects, aspects and advantages of the invention will become apparent upon studying the following detailed description and accompanying illustrations of a preferred embodiment of the invention and the claims to the invention.

BRIEF DESCRIPTION OF THE DRAWINGS

For a more complete understanding of the invention, reference should now be made to the embodiments illustrated in the accompanying drawings and described below. In the drawings.

Although these figures adequately illustrate the invention, they have not necessarily been drawn to scale. In addition, certain elements may have been partially or entirely omitted if they are not necessary for a proper understanding of the invention.

DETAILED DESCRIPTION OF THE DRAWINGS AND THE PREFERRED EMBODIMENT

Figure 1:
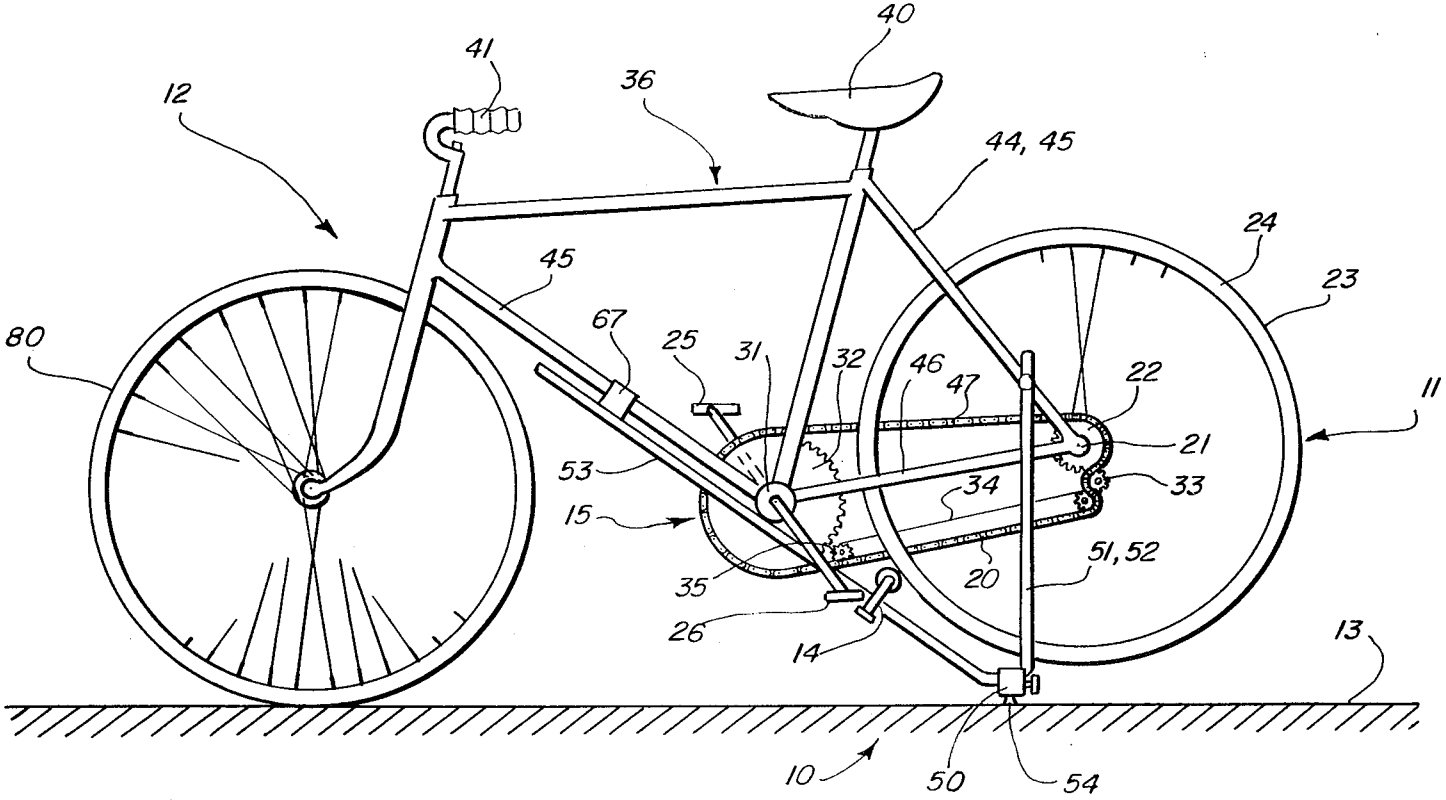
FIG. 1 is a side elevation view of the stationary bicycling stand and bicycle of one embodiment of the invention.

As shown in FIG. 1, a stationary bicycling stand 10 is provided which embodies the invention. Stand 10 supports the rear wheel assembly 11 of a bicycle 12 above the supporting surface 13, and includes a tension element 14 which frictionally engages and may readily be adjusted to resist rotation of the rear wheel assembly 11. Generally, the operation is as follows. The cyclist attaches the stand 10 to the bicycle 12, sets the tension element 14 to the desired resistance, and then mounts the bicycle 12 and operates it in the traditional manner, except that no forward motion occurs because the rear wheel assembly 11 is above the supporting surface 13.

Typically, the bicycle 12 has a rear wheel assembly 11 driven by a foot crank mechanism 15 via a chain 20. The rear wheel assembly 11 includes a shaft 21 and a gear cluster 22 and the rear wheel 23 mounted for rotation to the shaft 21, the rear wheel 23 having a tire 24 mounted along its periphery. The foot crank mechanism 15 includes a pair of opposed pedal-and-crank arrangments 25, 26, a crank axle (not shown) connected between the opposed pedal-and-crank arrangements 25, 26 a crank axle housing 31 which supports the crank axle 30 for rotation, and a chain wheel assembly 32 connected to the crank axle 30. The chain 20 loops around both the chain wheel assembly 32 and the gear cluster 22 and rotates the wheel 23 whenever the crank axle 30 is rotated by the opposed pedal-and-crank arrangements 25, 26. A gearing mechanism, including a rear derailleur 33 and cable 34 and a front derailleur 35, permits the chain 20 to be looped around various combinations of gears.

Both the rear wheel assembly 11 and the foot crank mechanism 15 are supported by a frame 36, which also supports a seat assembly 40 and a handlebar assembly 41. The frame 36 typically comprises several support members, including a seat tube 42, a down tube 43, two seat stays 44, 45 and two chain stays 46, 47. The rear wheel assembly 11 is mounted to the frame 36 between the chain stays 46, 47 and between the seat stays 44, 45, one chain stay 46 and seat stay 44 supporting one end of the shaft 21 and the other chain stay 47 and seat stay 45 supporting the other end of the shaft 21. The crank axle housing 31 is mounted to the frame 36 at the intersection of the down tube 43, the seat tube 42 and the chain stays 46, 47, such that the down tube 43, the seat tube 42 and the chain stays 46, 47 are located between the planes of rotation of the opposed pedal-and-crank arrangements 25, 26.

Operation of the bicycle 12 entails high-speed motion of many of these components in the vicinity of the chain stays 46, 47, e.g., rotation of the rear wheel 23 between the seat stays 44, 45 and between the chain stays 46, 47; running of the chain 20 between the rear wheel assembly 11 and the foot crank mechanism 15; and turning of the pedal-and-crank arrangments 25, 26 about the crank axle housing 31. The motion of these components can generate high frequency vibrations, especially if the rear wheel 23 is out-of-round. These vibrations could potentially cause the bicycle 12 to wobble and the attached stand 10 to "walk" along the supporting surface 13.

An even more serious cause of wobbling and "walking" is the pedaling motion of the cyclist. The cyclist is much more massive than the bicycle 12, and he sits high on the seat assembly 40. Consequently, as he alternately leans his body to one side of the bicycle 12 and forces one pedal-and-crank arrangement 25 down and then leans his body to the other side of the bicycle 12 and forces the other pedal-and-crank arrangment 26 down, he generates very large moments which thrust the bicycle 12 first one way and then the other.

My invention obviates the aforementioned problems by securely supporting and stabilizing the bicycle 12 during stationary operation without interfering with the pedaling of the cyclist or the moving parts of the bicycle 12. This is accomplished by providing a stand 10 comprising an elongate base 50, two angled, substantially rigid rear braces 51, 52 and an angled, substantially rigid front brace 53. The base 50 lies beneath and transverse to plane of the rear wheel 23 and extends equally beyond each side of the rear wheel 23. A plane normal to the supporting surface 13 and aligned with the elongate base 50 would intersect the chain stays 46, 47 anterior to the shaft 21. Two elastomeric pads 54, 55, one on each end of the base 50, rest on the supporting surface 13 to absorb vibrations and frictionally engage the surface 13 to help prevent "walking".

The angled, substantially rigid rear braces 51, 52 and the angled, substantially rigid front brace 53 securely stablize the bicycle 12 yet avoid interfering with any moving components. Each of the rear braces 51, 52 is similar in construction and mounting. For example, one of the rear braces 51 is bolted to one end of the base 50 and extends toward one of the chain stays 47 at an angle A to the base 50. At the chain stay 47, the rear brace 51 angles up towards and terminates just beyond the seat stay 45. A releasable means such as a "J" bolt connector attaches the rear brace 51 to the chain stay 47. A plastic pad 56 wraps around and protects the chain stay 47 from wear at the point of attachment. This pad 56, along with the protective pads mentioned below, may be made from vinyl or any other suitable plastic material. The "J" bolt 60 loops around and passes under the chain stay 47, passes through a hole 61 in the rear brace 51 and a washer 62, and is threaded to a nut 63. A similar "J" bolt connector attaches the rear brace 51 to the seat stay 45 at one of the other two holes 64, 65 in the rear brace 51, whichever best fits the frame 36. Another plastic pad 66 similarly wraps around and protects the seat stay 45 from wear. Use of the "J" bolt connectors allows the bicycle 12 to be readily attached to and detached from the stand 10 without marring the frame 36 of the bicycle 12. Since the plastic pads 56, 66 can be installed anywhere along the stays 45, 47, use of the "J" bolt connectors also allows the stand 10 to accommodate several styles and sizes of bicycle frames.

Attaching the rear braces 51, 52 to both the chain stays 46, 47 and the seat stays 44, 45 provides two generally vertically spaced points of contact between each brace 51, 52 and the frame 36 of the bicycle 12. (Of course, the stand 10 of the invention could be modified to accomodate three or more points of contact without departing from the scope of the invention.) This construction enables the stand to counter the moments and vibrations generated during operation of the bicycle, something that heretofore was not accomplished by attaching each base 51, 52 to the shaft 21 or to a chain stay 46, 47 alone, as has been traditionally done. Angling the rear braces 51, 52 away from the chain stays 46, 47 not only avoids any interference between the moving components and the stand 10, it also further enhances the ability of the stand 10 to counter the generated moments and vibrations. Consequently, the stand 10 of this invention virtually eliminates any wobbling or "walking" during stationary operation of the bicycle 12.

The angled front brace 53 further buttresses the stand 10 and stabilizes the bicycle 12 during stationary operation. The front brace 53 bolts to the center of the base 50, extends parallel to the supporting surface 13 for a distance, and then angles up toward the front crank mechanism 15, passing under the crank axle housing 31 and under and parallel to the down tube 43, to which it is connected by a clamp 67. A plastic pad 68 wraps around and protects the down tube 43 from wear. Passing the front brace 53 directly under the foot crank mechanism 15 and the rear wheel 23 ensures complete support of the cyclist without interfering with his pedaling movements or the moving components of the bicycle 12.

Figure 2:
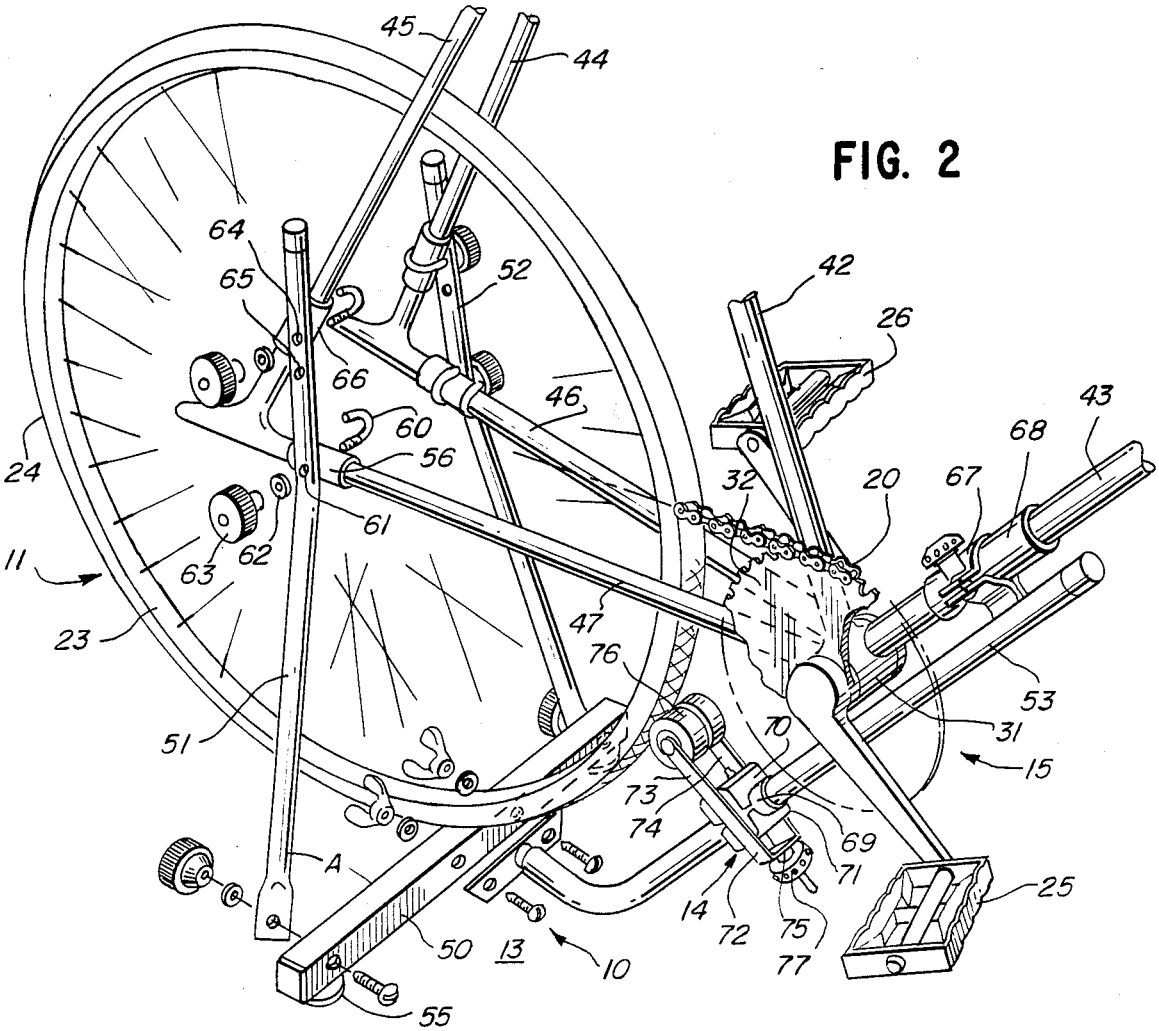
FIG. 2 is an exploded perspective view of the stationary bicycling stand and the tension element of the embodiment of FIG. 1.
Figure 3:
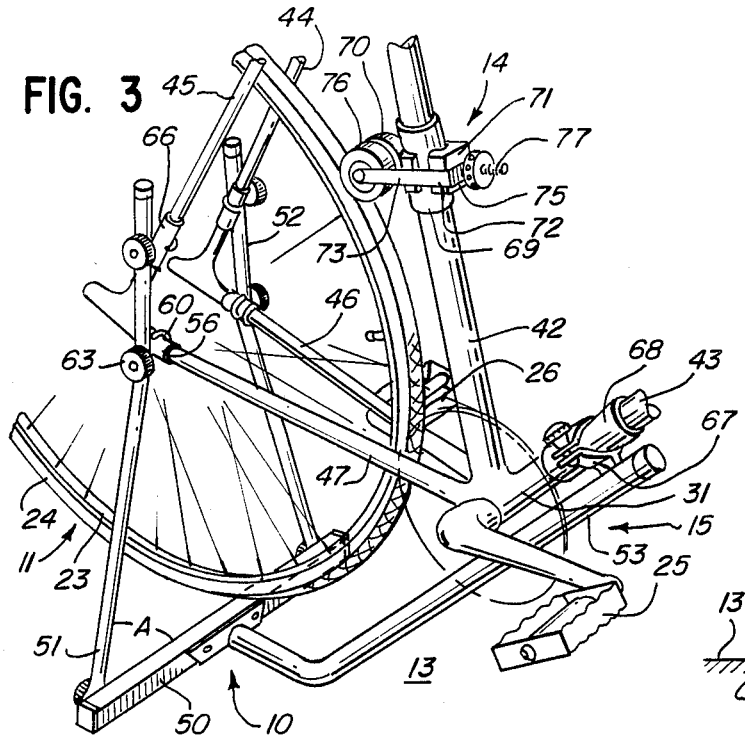
FIG. 3 is a perspective view of the stationary bicycling stand and the tension element of another embodiment of the invention.

To provide the desired resistance to rotation of the rear wheel 23, the tension element 14 is mounted to the angled front brace 53 as shown in FIG. 2 or, alternatively, to the seat tube 42 as shown in FIG. 3. A plastic pad 69 wraps around and protects the front brace 53 or the seat tube 42 from wear. The tension element 14 includes two brackets 70, 71 which clamp around the front brace 53 and a U-shaped member 72 with two leg portions 73, 74 and a bight portion 75. The leg portions 73, 74 slide through channels on each end of each bracket 70, 71, and a roller 76 is removably mounted for rotation at the end of the leg portions 73, 74. A threaded connector 77 joins the bight portion and one of the brackets 71 so that as the connector 77 is tightened, the bight portion 75 is drawn toward the bracket 71 and the leg portions 73, 74 slide through the channels in the brackets 70, 71.

Figure 4:
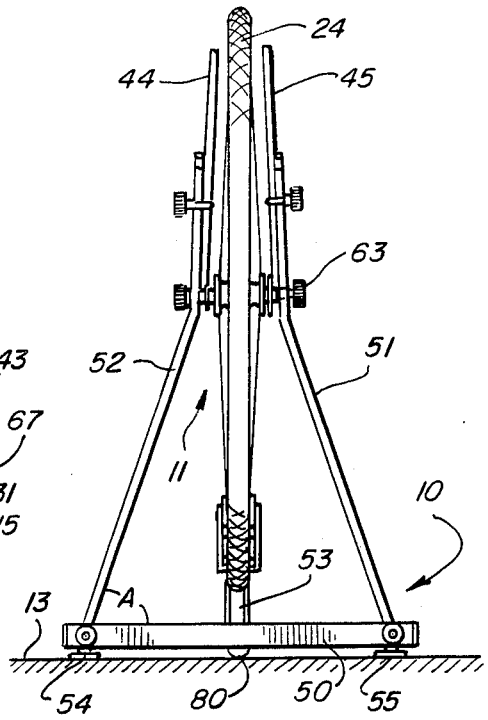
FIG. 4 is a rear elevation view of the stationary bicycling stand of the embodiment of FIG. 1.

The stand 10 is attached to the bicycle 12 preferably by turning the bicycle 12 upside down so that it rests on its seat assembly 40 and handlebar assembly 41. The stand 10, with the rear braces 51, 52 and the front brace 53 already bolted to the base 50, is then fitted to the bicycle 12. After the plastic pads 56, 66, 68 are installed, each rear brace 51, 52 is bolted to a chain stay 47, 46 and seat stay 45, 44 using the "J" bolt connectors, and the front brace 53 is connected to the down tube 43 using the clamp 66. The bicycle 12 with the stand 10 attached is then turned right side up so the front wheel 80 and the base 50 rest on the supporting surface 13 and the rear wheel 23 is supported above the supporting surface 13, as shown in FIG. 4. After the plastic pad 69 is installed, the tension element 14 is then mounted on either the front brace 53 or the seat tube 42 in frictional engagement with the tire 24 and is adjusted to provide the desired resistance to rotation of the wheel 23. The bicycle 12 is then securely supported by the stand 10 and is ready for stationary cycling.

While a particular embodiment of the invention has been described above, the invention is not so limited. Alternative embodiments and modifications which would still be encompassed by the invention may be made by those skilled in the art, particularly in light of the foregoing teachings. Therefore, the following claims are intended to cover any alternative embodiments, modifications or equivalents which may be included within the spirit and scope of the invention as claimed.

I claim:

1. A stand for supporting a bicycle for stationary bicycling on a supporting surface, said bicycle having a front wheel, a rear wheel and a frame interconnecting said front wheel and said rear wheel, wherein said stand comprises:

a base for engaging said supporting surface on both sides of the plane of rotation of said rear wheel, a first substantially rigid brace having an upper portion and a lower portion wherein the lower portion is attached to said base on a first side of said plane of rotation and the upper portion lies generally parallel to said plane of rotation and is attached to said frame by an adjustable, releasable means adapted to be attached at at least two generally vertically spaced points on said first side of said plane of rotation, a second substantially rigid brace having an upper portion and a lower portion wherein the lower portion is attached to said base on a second side of said plane of rotation and is attached to said frame by an adjustable, releasable means adapted to be attached at at least two generally vertically spaced points on said second side of said plane of rotation, and a third substantially rigid brace having a first portion and a second portion, said first portion being connected to and extending beneath and generally parallel to a central portion of said frame and said second portion being connected to said base.

2. The stand of claim 1 wherein said base extends beneath said rear wheel and said second portion of said third substantially rigid brace lies generally in said plane of rotation of said rear wheel and is connected to said base beneath said rear wheel.

3. A stand for supporting a bicycle for stationary bicycling on a supporting surface, said bicycle including a rear wheel and a frame which includes a down tube and a chain stay and a seat stay on both sides of the plane of rotation of said wheel, said stand comprising:

a base means extending under said rear wheel for engaging said supporting surface on both sides of said plane of rotation, a first substantially rigid brace having an upper portion and a lower portion, said upper portion being connected by an adjustable, releasable means adapted to be attached to said chain stay and said seat stay and said lower portion being connected to said base means on a first side of said plane of rotation, a second substantially rigid brace having an upper portion and a lower portion, said upper portion being connected by an adjustable, releasable means adapted to be attached to said chain stay and said seat stay and said lower portion being connected to said base means on a second side of said plane of rotation, and a third substantially rigid brace having a first portion and a second portion, said first portion being connected by an adjustable, releasable means adapted to be attached to and extending beneath and generally parallel to said down tube and said second portion generally lying in said plane of rotation of said rear wheel and being connected to said base means beneath said rear wheel.

4. The stand of claim 3 further comprising adjustable means frictionally engaging the pheriphery of said rear wheel for resisting rotation of said rear wheel.

* * * * *